US010174735B2

(12) United States Patent
Ritsch et al.

(10) Patent No.: US 10,174,735 B2
(45) Date of Patent: Jan. 8, 2019

(54) INJECTION DEVICE FOR AN INTERNAL COMBUSTION ENGINE

(71) Applicant: CONTINENTAL AUTOMOTIVE GMBH, Hannover (DE)

(72) Inventors: Tobias Ritsch, Regensburg (DE); Daniel Anetsberger, Regensburg (DE); Christoph Klesse, Woerth A. D. Donau (DE); Uwe Lingener, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 208 days.

(21) Appl. No.: 14/416,340

(22) PCT Filed: Jul. 17, 2013

(86) PCT No.: PCT/EP2013/065095
§ 371 (c)(1),
(2) Date: Jan. 22, 2015

(87) PCT Pub. No.: WO2014/016181
PCT Pub. Date: Jan. 30, 2014

(65) Prior Publication Data

US 2015/0204293 A1 Jul. 23, 2015

(30) Foreign Application Priority Data

Jul. 24, 2012 (DE) ..... 10 2012 212 892

(51) Int. Cl.
*F02M 63/00* (2006.01)
*F02M 63/02* (2006.01)
(Continued)

(52) U.S. Cl.
CPC .... *F02M 63/0035* (2013.01); *F02M 37/0023* (2013.01); *F02M 37/0058* (2013.01);
(Continued)

(58) Field of Classification Search
CPC ..... F02M 63/0035; F02M 37/0023
See application file for complete search history.

(56) References Cited

U.S. PATENT DOCUMENTS 4,855,041 A 8/1989 Church et al.
5,616,837 A * 4/1997 Leonard ..... F02M 65/00 73/114.42

(Continued)

FOREIGN PATENT DOCUMENTS

DE 757527 C 3/1954
DE 29610765 U1 10/1996

(Continued)

OTHER PUBLICATIONS

Schrader Valve, Wikipedia, May 21, 2008, (https://en.wikipedia.org/wiki/Schrader_valve#/media/File:Schrader_valve_opening_and_closing_on_a_tire.gif).*

*Primary Examiner* — Kevin A Lathers
(74) *Attorney, Agent, or Firm* — Laurence A. Greenberg; Werner H. Stemer; Ralph E. Locher

(57) ABSTRACT

An injection device for an internal combustion engine includes a fuel delivery pump and a high-pressure pump which are connected to one another via a low-pressure fuel line. A high-pressure accumulator is connected to the high-pressure pump. At least one injector is connected via a high-pressure fuel line to the high-pressure accumulator. The injection device also has at least one fuel return line which is connected to the high-pressure accumulator and/or to the at least one injector. The fuel return line issues into the low-pressure fuel line which connects the fuel delivery pump and the high-pressure pump to one another. At least one air bleed valve is arranged in the course of the low-pressure fuel line or on the high-pressure pump or on a filter housing.

7 Claims, 2 Drawing Sheets

(51) Int. Cl.

| | |
|---|---|
| ***F02M 37/00*** | (2006.01) |
| ***F02M 37/22*** | (2006.01) |
| ***F02M 55/00*** | (2006.01) |
| ***F02M 37/06*** | (2006.01) |
| *F02M 37/20* | (2006.01) |

(52) U.S. Cl.

CPC ..... *F02M 37/06* (2013.01); *F02M 37/22* (2013.01); *F02M 55/007* (2013.01); *F02M 63/0059* (2013.01); *F02M 63/028* (2013.01); *F02M 63/0225* (2013.01); *F02M 63/0265* (2013.01); *F02M 63/0275* (2013.01); *F02M 37/20* (2013.01)

(56) References Cited

U.S. PATENT DOCUMENTS

| | | | | |
|---|---|---|---|---|
| 6,273,072 | B1 * | 8/2001 | Knapstein ..... | F02M 17/22 123/524 |
| 6,564,776 | B1 | 5/2003 | Haeberer et al. | |
| 2009/0044866 | A1 * | 2/2009 | Pearson ..... | F02M 37/18 137/87.01 |

FOREIGN PATENT DOCUMENTS

| | | | |
|---|---|---|---|
| DE | 19946659 | * | 4/2001 |
| DE | 19946659 | A1 | 4/2001 |
| DE | 19956093 | A1 | 5/2001 |
| DE | 10342116 | * | 4/2005 |
| DE | 10342116 | A1 | 4/2005 |
| DE | 10345225 | A1 | 4/2005 |
| DE | 102007029808 | A1 | 1/2009 |
| DE | 102009046819 | A1 | 5/2011 |
| DE | 102009052597 | A1 | 5/2011 |
| EP | 0289188 | A2 | 11/1988 |
| WO | 0136809 | A1 | 5/2001 |
| WO | 2008043755 | A1 | 4/2008 |

* cited by examiner

INJECTION DEVICE FOR AN INTERNAL COMBUSTION ENGINE

BACKGROUND OF THE INVENTION

Field of the Invention

The invention relates to an injection device for an internal combustion engine comprising a fuel delivery pump and a high-pressure pump, which are connected to one another via a low-pressure fuel line, a high-pressure reservoir, which is connected to the high-pressure pump, and at least one injector, which is connected via a high-pressure fuel line to the high-pressure reservoir. The injection device furthermore has at least one fuel return line, which is connected to the high-pressure reservoir and/or to the at least one injector.

In the case of internal combustion engines with conventional common rail injection systems, the fuel, which is delivered by a feed pump typically arranged in a fuel tank of a motor vehicle, is brought to a high pressure level by means of a high-pressure pump and fed to a high-pressure reservoir. From there, the fuel is injected into combustion chambers of the internal combustion engine by means of injectors. During operation, the high pressure level is maintained continuously. For pressure regulation, a pressure regulating valve is generally arranged on the high-pressure reservoir. The fuel discharged via said valve is then fed back into the fuel tank of the motor vehicle via a fuel return line. In the case of diesel injection systems, the injectors used to inject the fuel into the combustion chamber typically also have fuel leakage connections, which are connected to the fuel tank by a fuel return line. In the prior art, such fuel return lines are also used, as in the publication DE 103 45 225 B4, to bleed air from injection devices.

In most motor vehicles, the fuel tank is arranged at the rear for reasons of design, thus necessitating fuel lines of corresponding length to connect the engine, which is arranged at the front of the motor vehicle, to the fuel tank. To implement a fuel circuit of the type described, which is formed with a feed and a return, a correspondingly high outlay on materials is necessary. Moreover, the length of such a fuel circuit is a possible source of faults in terms of leaks. Both entail disproportionately high costs. It is the underlying object of the invention to provide a low-cost injection device for an internal combustion engine which can be implemented with a relatively low outlay on materials.

BRIEF SUMMARY OF THE INVENTION

According to the invention, the object is achieved by an injection device having the features as claimed. Specific embodiments can be found in the dependent claims.

The injection device according to the invention for an internal combustion engine comprises a fuel delivery pump, typically arranged in a fuel tank, and a high-pressure pump, which is connected by a low-pressure fuel line to the fuel delivery pump, a high-pressure reservoir, which is connected to the high-pressure pump, and at least one injector, which is connected via a high-pressure fuel line to the high-pressure reservoir, wherein the injection device furthermore has at least one fuel return line, which is connected to the high-pressure reservoir and/or to the at least one injector, wherein the fuel return line issues into the low-pressure fuel line or into a fuel filter arranged in the course of the low-pressure fuel line, which connects the fuel delivery pump and the high-pressure pump to one another.

Moreover, at least one air bleed valve is arranged in the course of the low-pressure fuel line.

By virtue of the fact that the fuel return line does not issue into the fuel tank but into the low-pressure fuel line mentioned, the fuel line can be made significantly shorter than in the case of comparable conventional injection systems of the type described at the outset. However, this initially entails the difficulty that there is also no line available via which air can be bled from the injection device into the fuel tank. Such bleeding can be necessary, for example, if the fuel tank is emptied, allowing air to enter the injection device.

Moreover, there is normally still air in the injection device before the internal combustion engine is first put into operation, and this must therefore be removed to enable the high-pressure pump to fill the high-pressure reservoir with fuel and put it under pressure. For this reason, the air bleed valve is provided according to the invention, being arranged in the course of the low-pressure fuel line or on the high-pressure pump or on a filter housing. This air bleed valve makes it possible to bleed air from the injection device by means of the fuel delivery pump. For this purpose, all that is required is to put the fuel delivery pump into operation—this generally being accomplished, in the case of a motor vehicle, by turning the ignition key to a first position—when the air bleed valve is open. The latter can then be closed again as soon as there is no longer air but only fuel there.

The invention described is particularly expedient when the high-pressure pump is a pump which does not have fuel lubrication, that is to say, in particular, does not have a fuel lubrication circuit. The reason for this is that there is no need in such pumps not lubricated with fuel for a fuel return line routed back into the fuel tank, which could then also be used for air bleeding. Thus, the high-pressure pump can be designed in such a way that it is lubricated with engine oil from the internal combustion engine: in the case of a high-pressure pump driven by a camshaft of the internal combustion engine, for example, by arrangement on the camshaft, which is supplied in any case by a lubricant circuit of the internal combustion engine.

The fuel delivery pump, which can also be referred to as a feed pump, is used to supply fuel to the high-pressure pump and can be designed as a vane pump, an eccentric pump or piston pump, for example. For this purpose, the fuel delivery pump can be arranged in the fuel tank or at least in such a way that fuel can be drawn in from a fuel tank and delivered. Particularly also if there are air bubbles in the low-pressure fuel line and/or the fuel return line in the case, for example, of initial starting of a new vehicle, in the case of a restart after the fuel tank has been emptied or after a change of fuel filter, this fuel delivery pump should be capable of delivering fuel from the fuel tank via the low-pressure fuel line in the direction of the high-pressure pump. The fuel delivery pump can therefore be used in the manner described above for removing air.

The high-pressure reservoir can have a pressure regulating valve which is connected to the fuel return line. When a limiting value for a pressure in the high-pressure reservoir is reached, the pressure regulating valve can be opened by means of an electric actuator arranged thereon, allowing the pressure to be reduced selectively. The at least one injector can once again have a leakage connection, via which escaping fuel can be discharged into the fuel return line. The fuel return line, which is connected to the leakage connection of the at least one injector and/or to the pressure regulating valve of the high-pressure reservoir, issues into the low-pressure fuel line connecting the fuel delivery pump and the high-pressure pump to one another or into the fuel filter arranged in the course of the low-pressure fuel line. At the same time, this fuel return line should preferably be arranged in such a way that the distance to the point of issue into the low-pressure fuel line is as short as possible. It is particularly advantageous if the fuel return line, which is made as short as possible with a view to saving materials, issues into the low-pressure fuel line just ahead of the high-pressure pump, ideally directly ahead of a fuel filter arranged in front of said pump.

In principle, a single air bleed valve is sufficient to fully bleed the injection system. However, it may be helpful if the injection device has one or more further air bleed valves, which can also be arranged in the course of the fuel return line.

The air bleed valve arranged in the course of the low-pressure fuel line can be a 2/2-way valve or a 3/2-way valve, for example. When using the 2/2-way valve, a T-piece should be arranged in the course of the low-pressure fuel line, one end of said piece then being connected to the 2/2-way valve. In contrast, the 3/2-way valve can be arranged directly in the course of the low-pressure fuel line.

As an advantageous option, the air bleed valve can also be a Schrader valve or a hydraulic coupling, which per se is suitable for removing air in a particularly simple manner.

A fuel filter can be arranged in the course of the low-pressure fuel line connecting the fuel delivery pump and the high-pressure pump to one another. In this case, the air bleed valve can be integrated into the fuel filter. The air bleed valve is preferably arranged between the fuel filter and the high-pressure pump. It is particularly advantageous if the air bleed valve is arranged directly ahead of the high-pressure pump or in the high-pressure pump, preferably on a low-pressure side, to enable air to be removed from the injection device as completely as possible.

For opening into the bleeding position and/or for closing into the initial position, the air bleed valve can have an electric or hydraulic or pneumatic actuator, which is designed as an electromagnetic relay, for example. However, it is also possible to envisage the air bleed valve being mechanically actuated. For this purpose, there can be the possibility of moving the air bleed valve into the bleeding position by means of a push button, for example, or—in the case of a Schrader valve or of a hydraulic coupling, for example—automatically by connection of a bleed line. For closing, the air bleed valve can have a return spring, by means of which the air bleed valve can be moved into an initial position or closed position by spring force.

In order to bleed the injection device described, the outlet of the air bleed valve can be connected to a line which leads into a collecting container which collects fuel emerging at the end of the bleeding process. Thus, an advantageous arrangement for bleeding an injection device is obtained containing an injection device having the features described above, a collecting container and a line leading from the outlet of the air bleed valve arranged in the course of the low-pressure fuel line into the collecting container. In this case, the line can be embodied as a hose or a pipe.

Bleeding can be rendered easier by drawing fuel out of the still not bubble-free low-pressure fuel line. For this purpose, a suction pump can be arranged in the line leading from the outlet of the air bleed valve into the collecting container, for example. For the same purpose, a pump of this kind which can be switched on when the air bleed valve is actuated can also be arranged in or on the outlet container.

BRIEF DESCRIPTION OF THE SEVERAL VIEWS OF THE DRAWING

It is particularly expedient to embody injection devices for diesel engines in the manner described if the internal combustion engine on which the injection device is used is a diesel engine. This is due to the fact that, on the one hand, diesel engines cannot generally manage without a return line and that other ways of bleeding—via the injectors into the combustion chambers of the engines, for example—are virtually impossible to implement in diesel engines. The illustrative embodiments of the invention are explained in greater detail below with reference to two FIGS. 1 and 2, of which.

DESCRIPTION OF THE INVENTION

Figure 1:
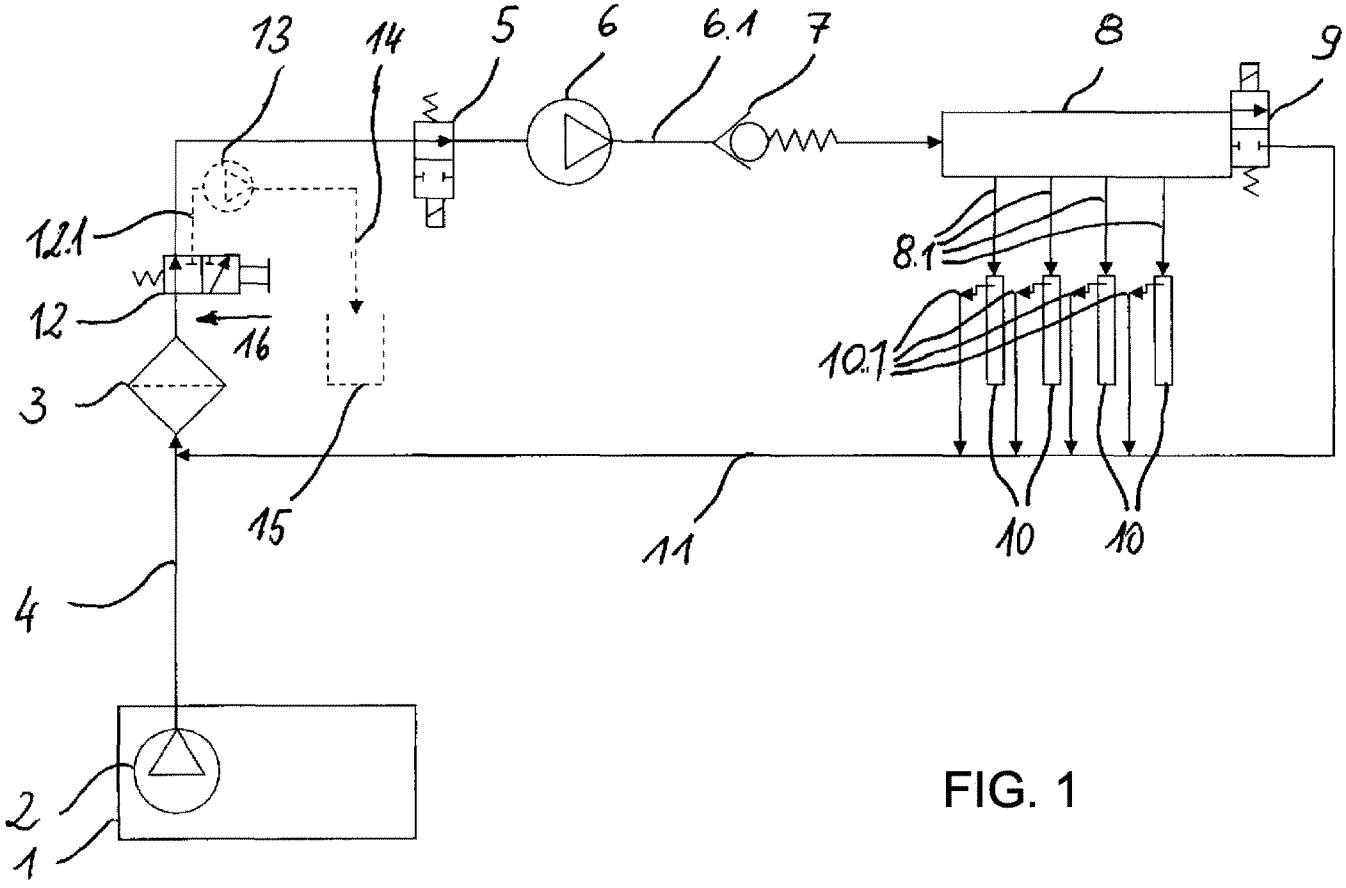
FIG. 1 shows a schematic illustration of an injection device having an air bleed valve with spring return.

FIG. 1 shows an injection device of an internal combustion engine, which, in the present case, is a diesel engine. The injection device has a fuel delivery pump 2, which is arranged in a fuel tank 1 and is connected by a low-pressure fuel line 4 to a high-pressure pump 6 lubricated with engine oil. A fuel filter 3 is arranged in the course of the low-pressure fuel line 4. Directly ahead of the high-pressure pump 6, the injection device has a volume flow control valve 5 arranged directly on the high-pressure pump 6. Moreover, the injection device comprises a high-pressure reservoir 8, which is connected on the inlet side to the high-pressure pump 6 by a high-pressure fuel line 6.1, wherein a check valve 7 that opens in the delivery direction is arranged in the high-pressure fuel line 6.1. Furthermore, the injection device comprises a pressure regulating valve 9, which is arranged on the high-pressure reservoir 8 and the outlet of which is connected to a fuel return line 11. The fuel return line 11 issues into the low-pressure fuel line 4. Finally, the injection device has four low-leakage injectors 10, which are each connected on the inlet side to the high-pressure reservoir 8 by a high-pressure fuel line 8.1, wherein each of the injectors 10 has a leakage connection 10.1 connected to the fuel return line 11 issuing into the low-pressure fuel line 4.

In one embodiment of the injection device, provision is made for the fuel return line 11 to issue into the fuel filter 3 arranged in the course of the low-pressure fuel line 4.

The high-pressure pump 6 is a pump that is driven by a camshaft of the internal combustion engine and is supplied with a sufficient quantity of engine oil for lubrication through arrangement on the camshaft and, in particular, does not require fuel lubrication and a dedicated lubrication circuit.

Arranged in the low-pressure fuel line 4, between the fuel filter 3 and the volume flow control valve 5 is an air bleed valve 12 with spring return, on which there is arranged a push button for actuation, by means of which the air bleed valve 12 can be moved into the bleeding position in an actuating direction 16 for opening.

In a special embodiment of the injection device, the air bleed valve 12 can also be integrated into the fuel filter 3 or arranged on a filter housing. At any rate, it is preferably arranged just ahead of or in the high-pressure pump 6, preferably on a low-pressure side, i.e. directly ahead of the volume flow control valve 5.

In another embodiment, an electric actuator (not shown), which is embodied as an electromagnetic relay, is provided for actuation, i.e. to move the air bleed valve 12 into the bleeding position or to move it into an initial position.

If there is air in the injection device—e.g. after the fuel tank 1 has been emptied or before first putting the internal combustion engine into operation—this injection device can be bled as follows:

For this purpose, the air bleed valve 12 is moved into the bleeding position, and the fuel delivery pump 2 is actuated, e.g. by turning the ignition key to a first position or automatically through the actuation of the air bleed valve 12. As a result, the fuel delivery pump 2, which can be embodied as a vane pump, pumps fuel out of the fuel tank 1 into the low-pressure fuel line 4. The fuel delivered displaces air bubbles which may have accumulated in the low-pressure fuel line 4 or in the fuel filter 3 arranged in the course of the low-pressure fuel line 4 and takes said bubbles along, pushing them ahead of itself, through the rest of the low-pressure fuel line 4. The air bleed valve 12, which, in the present case, is designed as a 3/2-way valve, is moved in movement direction 16 into the bleeding position by pressing the pushbutton or through electric actuation. As a result, the fuel delivered to remove air discharges the air bubbles pushed ahead of it via an outlet 12.1 of the air bleed valve 12. It is expedient if this outlet 12.1 is connected to a collecting container 15, e.g. by means of a hose 14. The fuel which emerges during bleeding thus collects in the collecting container 15, which is held under the outlet 12.1 of the air bleed valve 12 for example. To facilitate bleeding, a suction pump 13 can be arranged in the course of the hose 14. The collecting container can also be put under pressure. In the illustrative embodiment under consideration, the air bleed valve 12 blocks the low-pressure fuel line 4 in the direction of the high-pressure pump 6 during the bleeding process.

The air bleed valve 12 remains in the bleeding position until there is no longer any air escaping via the outlet 12.1 of the air bleed valve 12 and only bubble-free fuel is emerging. When the pushbutton is released, the spring-loaded air bleed valve 12 moves into the initial position (closed position). In the other embodiment mentioned, the air bleed valve can be moved back into the initial position in a corresponding manner through actuation by the actuator.

Figure 2:
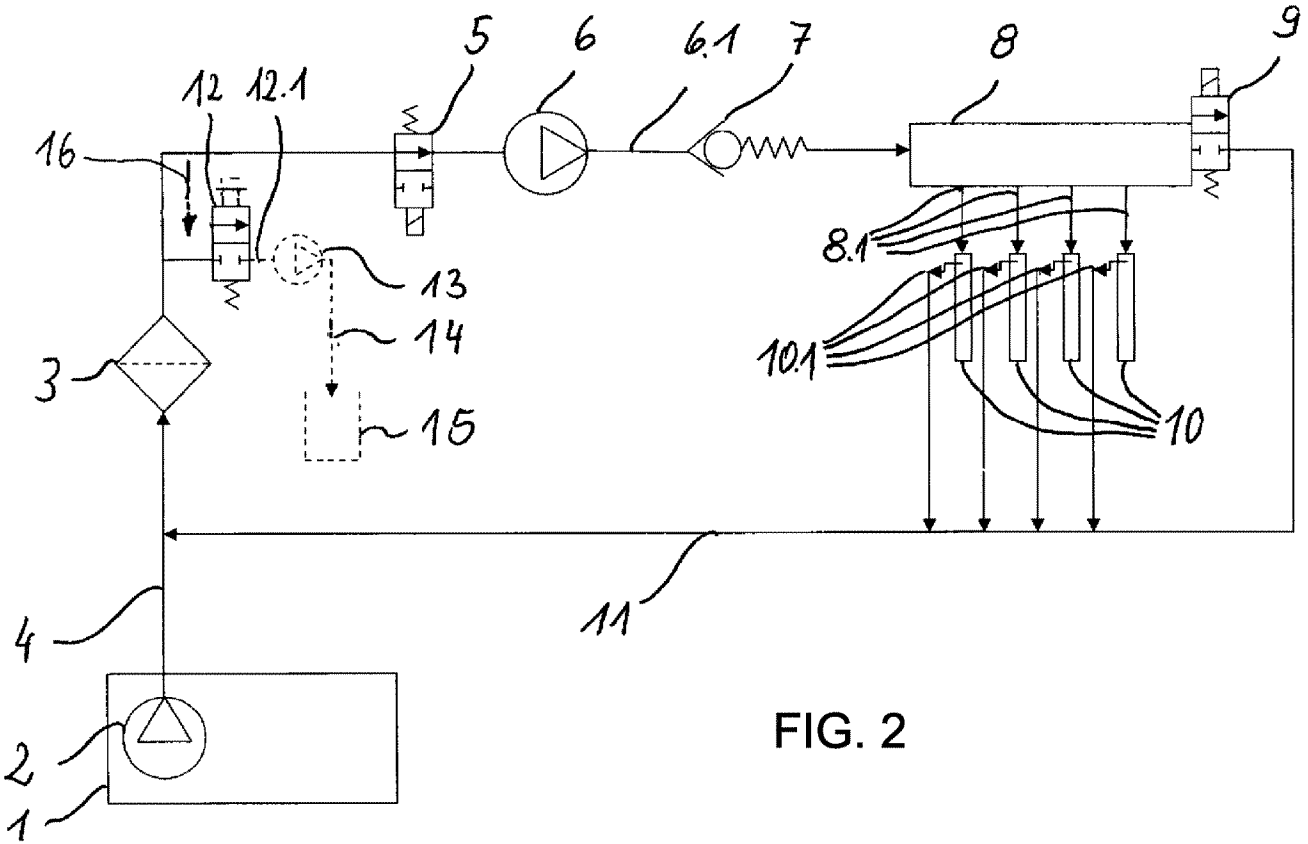
FIG. 2 shows a schematic illustration of an injection device having an air bleed valve arranged on a T-piece.

The injection device illustrated in FIG. 2 corresponds very largely to the injection device described above with reference to FIG. 1, and the repeated features are again denoted by the same reference signs. The only difference relative to the first illustrative embodiment is due to the fact that the air bleed valve 12 is embodied as a 2/2-way valve and that a T-piece is arranged in the course of the low-pressure fuel line 4 in order to connect the air bleed valve 12 to the low-pressure fuel line. The 2/2-way valve can be a Schrader valve or a hydraulic coupling or, once again, can be a manually or electrically actuated valve.

Removal of air from the injection device in FIG. 2 is accomplished as in the illustrative embodiment described above, but the actuation of the 3/2-way valve is replaced by the opening of the 2/2-way valve.

The invention claimed is:

1. An injection device for an internal combustion engine, the injection device comprising:

a fuel delivery pump and a high-pressure pump connected to one another via a low-pressure fuel line;

a high-pressure reservoir connected to said high-pressure pump;

at least one injector connected to said high-pressure reservoir via a high-pressure fuel line;

at least one fuel return line connected directly to a leakage connection of said at least one injector;

at least one air bleed valve disposed at a location selected from the group consisting of a course of said low-pressure fuel line directly upstream of said high-pressure pump, and at a low pressure side in said high-pressure pump;

said at least one fuel return line issuing into said low-pressure fuel line in between said at least one air bleed valve and said fuel delivery pump;

said at least one air bleed valve being a Schrader valve or a hydraulic coupling and said at least one air bleed valve including an actuator for automatically opening and/or closing said at least one air bleed valve.

2. The injection device according to claim 1, wherein said at least one air bleed valve is a 2/2-way valve or a 3/2-way valve.

3. The injection device according to claim 1, which comprises a fuel filter disposed inline in the course of said low-pressure fuel line connecting said fuel delivery pump and said high-pressure pump to one another.

4. The injection device according to claim 3, wherein said at least one air bleed valve is integrated into said fuel filter or is arranged between said fuel filter and said high-pressure pump.

5. An arrangement for bleeding an injection device, the arrangement comprising:

an injection device according to claim 1;

a collecting container for collecting fuel; and a line leading from an outlet of said at least one air bleed valve into said collecting container for delivering fuel from said at least one bleed valve to said collecting container at an end of a bleeding process.

6. The arrangement according to claim 5, wherein said collecting container is configured to be operated with vacuum pressure.

7. The arrangement according to claim 5, which comprises a suction pump disposed in said line between said air bleed valve and said collecting container.

* * * * *